United States Patent [19]

Müller

[11] Patent Number: 4,538,399

[45] Date of Patent: Sep. 3, 1985

[54] APPARATUS FOR EVACUATING AND SEALING RECTANGULAR PACKAGES

[75] Inventor: Werner Müller, Neuhausen am Rheinfall, Switzerland

[73] Assignee: SIG Schweizerische Industrie-Gesellschaft, Neuhausen am Rheinfall, Switzerland

[21] Appl. No.: 624,170

[22] Filed: Jun. 25, 1984

[30] Foreign Application Priority Data

Jun. 24, 1983 [CH] Switzerland ..... 3463/83

[51] Int. Cl.[3] ..... B65B 31/04

[52] U.S. Cl. ..... 53/512; 53/95

[58] Field of Search ..... 53/86, 89, 91, 92, 93, 53/95, 512, 526

[56] References Cited

U.S. PATENT DOCUMENTS

| | | | |
|---|---|---|---|
| 2,235,394 | 3/1941 | Berch | 53/512 |
| 2,933,868 | 4/1960 | Graefingholt | 53/95 |
| 2,966,019 | 12/1960 | Graefingholt | 53/86 |
| 3,010,264 | 11/1961 | Christensson | 53/95 |
| 3,058,274 | 10/1962 | Christensson | 53/95 |
| 3,103,771 | 9/1963 | Graefingholt | 53/95 |
| 3,220,157 | 11/1965 | Buchner | 53/86 |
| 3,501,888 | 3/1970 | Egli et al. | 53/86 |

FOREIGN PATENT DOCUMENTS

| | | | |
|---|---|---|---|
| 1486054 | 1/1969 | Fed. Rep. of Germany | 53/512 |
| 988840 | 4/1965 | United Kingdom | 53/512 |

*Primary Examiner*—John Sipos
*Assistant Examiner*—Donald R. Studebaker
*Attorney, Agent, or Firm*—Spencer & Frank

[57] ABSTRACT

An apparatus for evacuating and sealing rectangular packages includes a turntable, a plurality of vacuum hoods arranged circumferentially on the turntable and having an open position in which a package to be evacuated and sealed is received and a sealed, closed position. There is provided a package-engaging surface on each hood on its inside and an abutting mechanism arranged on the turntable below each vacuum hood. Each abutting mechanism also has a package-engaging surface. The abutting mechanism is arranged for radially outward movement for displacing, with its package-engaging surface, a package towards the package-engaging surface of the vacuum hood. In the closed position of the vacuum hood the package thereunder is engaged at opposite sides by the two surfaces.

10 Claims, 5 Drawing Figures

APPARATUS FOR EVACUATING AND SEALING RECTANGULAR PACKAGES

BACKGROUND OF THE INVENTION

This invention relates to an apparatus for evacuating and closing (sealing) rectangular packages and is of the type which has a platform rotatable about a vertical axis and carries a plurality of circumferentialy distributed, liftable vacuum hoods for enclosing the packages to be closed. The packages are advanced to the platform on a conveyor device.

Apparatuses of the above type are disclosed, for example, in British Pat. No. 988,840 and U.S. Pat. No. 2,933,868. In the machines disclosed therein, on the rotary platform there are provided chambers which are open in the circumferential direction and into which the packages are pushed. After insertion of the packages the chambers are evacuated and the packages are closed by sealing tongs. The closed packages are grasped by removal tongs and lifted onto a conveyor device.

Machines of the above-outlined known type have the disadvantage that the aesthetic appearance of the packages is often adversely affected by pressure marks and deformed portions and further, the packages vary in volume and configuration.

SUMMARY OF THE INVENTION

It is an object of the invention to provide an improved apparatus of the above-outlined type by means of which rectangular packages can be handled in a gentle, rapid and economical manner such that the above-outlined disadvantages are eliminated.

These objects and others to become apparent as the specification progresses, are accomplished by the invention, according to which, briefly stated, on the rotary platform, under each vacuum hood, there is provided at least one radially displaceable abutment for positioning a package, which is in engagement with the abutment, against the inside of the outer wall of the vacuum hood when the latter is in its lowered (operative) position.

DESCRIPTION OF THE PREFERRED EMBODIMENT

Figure 1:
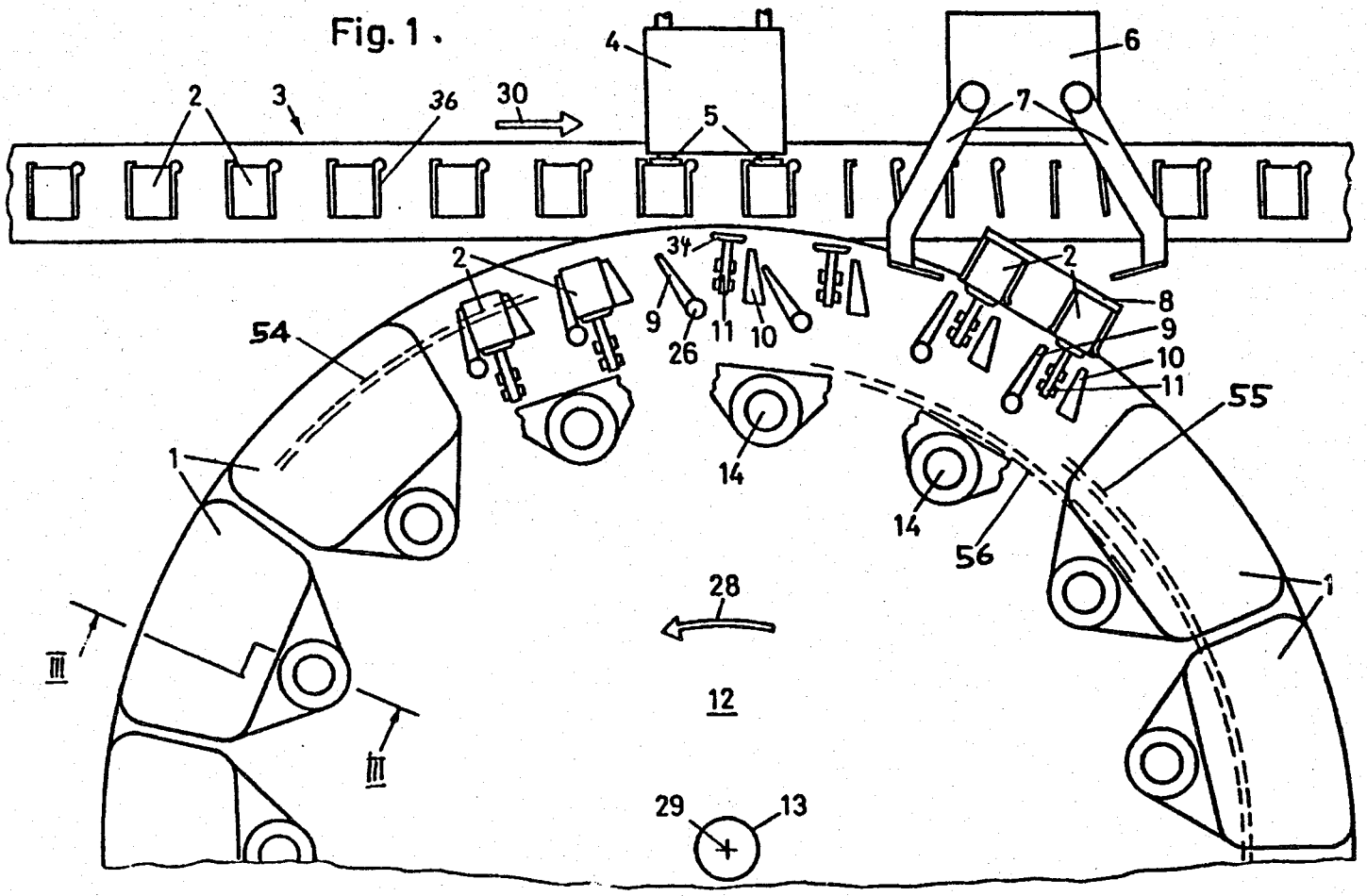
FIG. 1 is a schematic top plan view of a preferred embodiment of the invention.

Turning now to FIG. 1, the apparatus shown therein comprises a rotary platform (turntable) 12 which has a vertical shaft 13 and which is rotatable in the direction of the arrow 28 about the vertical axis 29 intermittently or continuously by means of a drive known by itself. On the platform 12 there are arranged, in a uniform circumferential distribution, a plurality of tightly closable vacuum hoods 1 in which packages 2 are received and treated. Some of the vacuum hoods are shown only fragmentarily to reveal components thereunder. The packages 2 are supplied to the platform 12 by means of a filling and conveying device 3. The platform 12 further supports circumferentially arranged, longitudinally displaceable vertical plungers 14, each carrying a respective vacuum hood 1. The plungers 14 have, underneath the turntable 12, a lower follower end (not shown) which engages a stationarily supported cam disc (also not shown) which, dependent upon the angular position of the platform 12 raise or lower selected plungers 14 and their associated vacuum hood 1.

Figure 4:
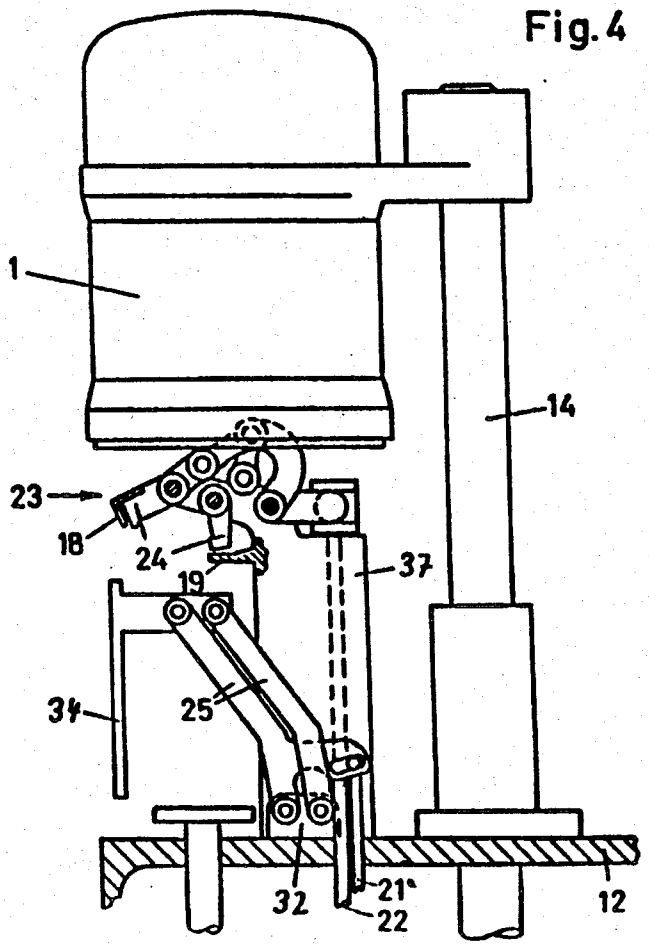
FIG. 4 is a sectional elevational view similar to FIG. 3 but showing components in a different operational position.
Figure 3:
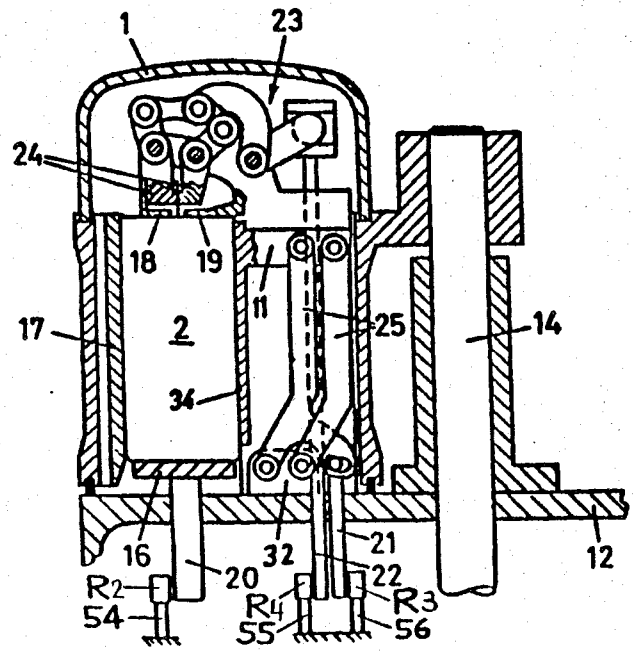
FIG. 3 is an enlarged sectional elevational view taken along line III—III of FIG. 1.
Figure 5:
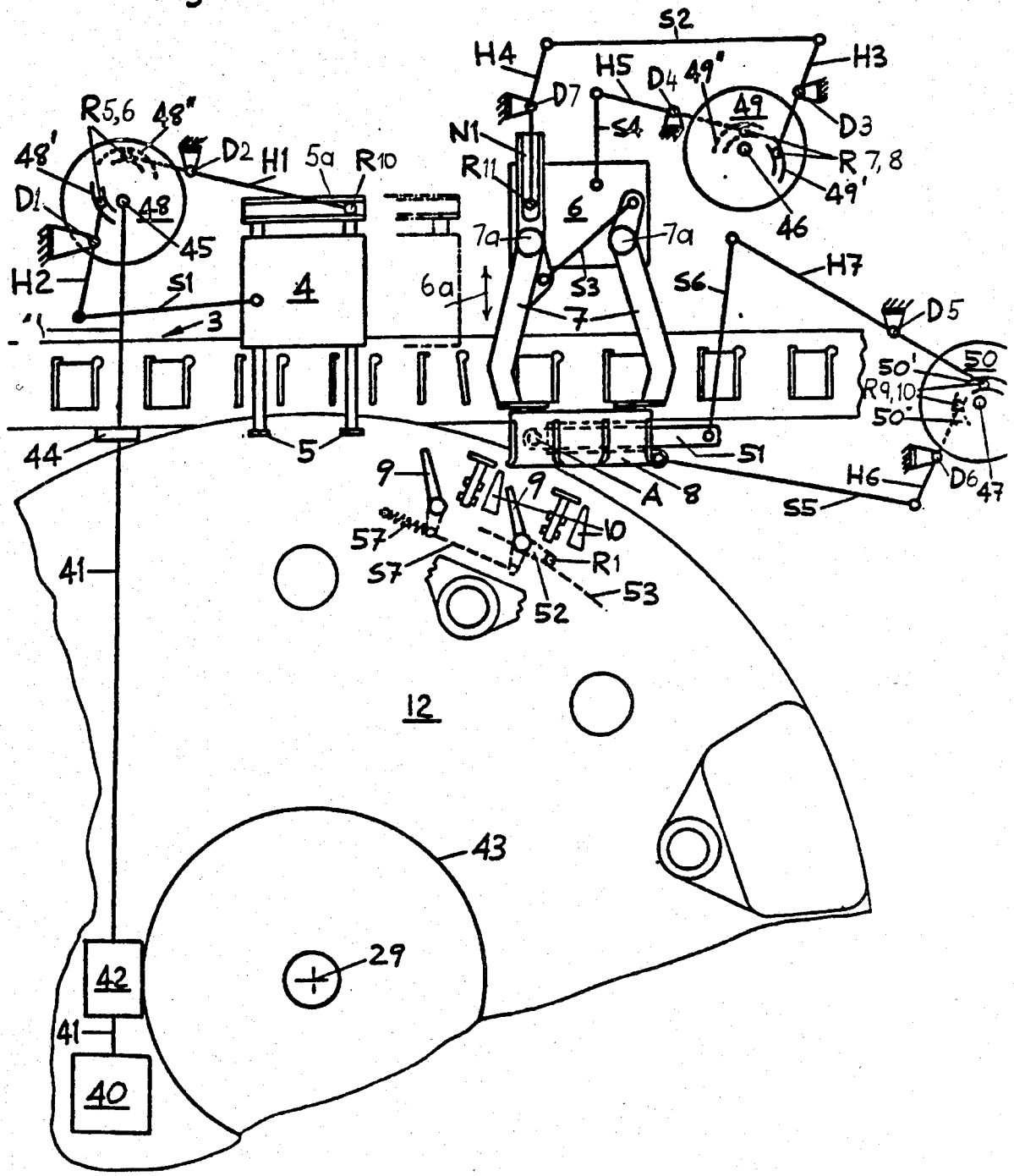
FIG. 5 is a schematic top plan view of the preferred embodiment, illustrating additional details of driving components.

Also referring to FIGS. 3, 4 and 5, underneath each vacuum hood 1 there are provided two radially displaceable ejectors 11, each connected to two parallel-guided pivotal arms 25. The pivotal arms 25 are supported on a bearing block 32 and are pivoted by means of a vertically displaceable plunger 21 passing through the platform 12. Each ejector 11 has a plate 34 which has a planar work face lying in a vertical plane and which extends generally tangentially to the platform 12. On the platform 12 there are provided, perpendicularly to each plate 34 and on opposite sides of each ejector 11, a stationary jaw 10 and a pivotal jaw 9. The pivotal jaw 9 is controlled by means of a cam track 53 which is engaged by a follower roller Rl carried on an arm 52 of the shaft 26 of the pivotal jaw 9. A spring 57 urges, with the intermediary of a connecting rod S7, the arm 52 and the follower roller Rl against the cam track 53 (FIG. 5). Sealing tongs 23, having two heated sealing shoes 24, are mounted on a carrier 37 above each ejector 11. Each carrier 37 further supports a hold-down plate 19, and to one of the sealing shoes 24 there is secured a hold-down plate 18. The two hold-down plates 18 and 19 form support surfaces for a package 2 when the sealing tongs 23 are in a closed position.

The opening and closing motions of the sealing tongs 23 are controlled by a vertically displaceable plunger 22 supported and guided in the platform 12. On the platform 12 underneath the sealing tongs 23 there is provided a separate base plate 16 which is secured to a respective plunger 20 whose height is controlled by a cam track 54 engaged by a follower roller R2 carried by the plunger 20. Likewise, the plungers 21 and 22 also carry respective follower rollers R3 and R4 which travel on respective cam tracks 55, 56. The configuration of the cam face of cam tracks 53–56 arranged underneath the platform 12 is not shown in further detail.

Figure 2:
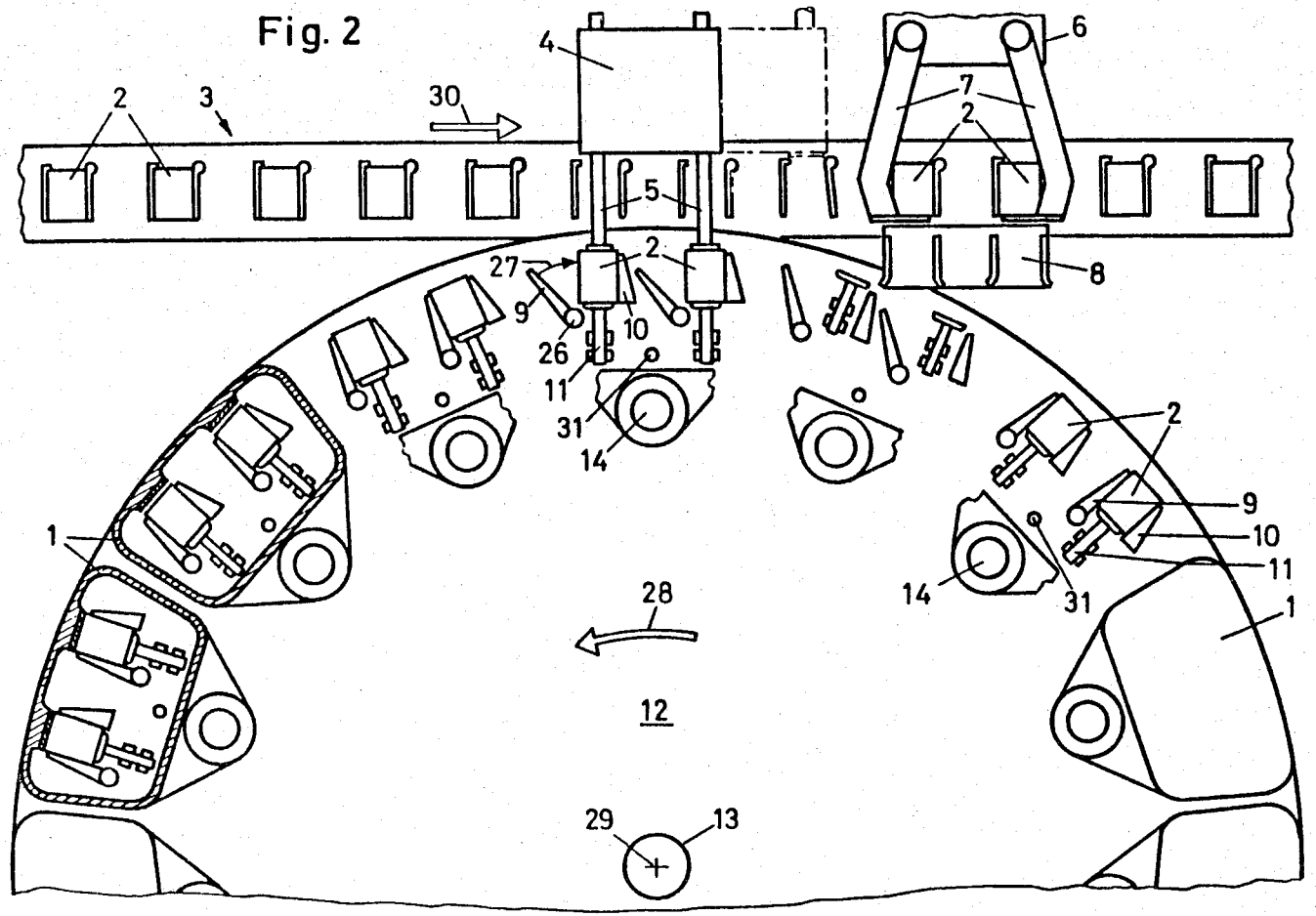
FIG. 2 is a schematic top plan view of the same embodiment, depicting the structure in a different operational position.

In the description which follows, the operation of the above-described apparatus will be set forth, with further reference to FIGS. 2 and 5.

By means of the conveyor 3 moving linearly in the direction of the arrow 30, simultaneously two filled and upwardly open packages 2 are brought in receptacles 36 in front of an inserting device 4 which has two article pushers 5 displaceable generally radially to the platform 12. The pushers 5 displace both packages 2 simultaneously underneath the raised vacuum hood 1 which at that time is in alignment with the article inserting mechanism 4. During this occurrence, the two outwardly pivoted ejectors 11 are pushed radially inwardly (in the direction of the turntable axis 29) by the two packages 2 as they engage the respective plate 34. At the same time, the movable jaws 9 pivot in the direction of the arrow 27 inwardly and press the packages 2 against the cooperating stationary jaws 10 so that in this operational phase each of the two packages 2 is supported at three surfaces in a form-retaining manner.

Subsequently, the pushers 5 are withdrawn and simultaneously, the inserting device 4 is, with the advancing conveyor 3, brought into its phantom-line position shown in FIG. 2 and then returned into its standby position while the pushers 5 are withdrawn thereinto.

In a successive operational phase, the vacuum hood 1 is lowered over the packages 2 and the thus formed airtight chamber is evacuated through an opening 31 provided in the turntable 12. At the same time, or shortly thereafter, both packages 2 are slid by the plate 34 (abutment plate) against a vertical support plate 17 of the vacuum hood 1 until the packages 2 are in engagement with the plate 17 (FIG. 3). The latter is mounted on the rear wall of the vacuum hood 1.

Thereafter, the packages are raised by means of the respective base plates 16 and sealed by the respective sealing tongs 23. In this operational phase the rectangular packages 2 are positively supported on all six faces by means of planar surfaces: at the top by hold-down plates 18 and 19, at the bottom by base plate 16 and at the four vertical package faces by plates 17, 34 and jaws 9, 10, respectively.

In successive operational steps the chamber underneath the vacuum hood 1 is aereated through the opening 31 and the vacuum hood 1 is raised. By means of the ejectors 11 both packages are simultaneously pushed onto a pivotal sled 8 and are grasped by removal grippers 7 of a removing device 6 and are deposited on the conveyor 3 which moves the packages away from the evacuating and sealing apparatus.

Further driving components for the apparatus are illustrated in FIG. 5. Thus, a motor 40 rotates, with the intermediary of a shaft 41, a screw gear 2 which meshes with a worm gear 43 affixed concentrically to the turntable 12 and thus rotating the same about the axis 29. The motor 40 further drives a gear 44 which moves the conveyor device 3. The shaft 41 further rotates cam discs 48, 49 and 50 by virtue of it being connected to their respective drive shafts 45, 46 and 47. Each cam disc 48, 49 and 50 is 20 provided with two independent cam grooves 48', 48'', 49', 49'' and 50', 50'', respectively. As will be discussed in more detail below, into each cam groove (cam track) there engages a respective follower roller carried by respective two-armed levers supported for pivotal motion at fixed pivotal joints. As the cam discs rotate, the two-armed levers pivot about their respective support D1–D6 to actuate various components also to be discussed later.

The pushers 5 are, at their rear terminus, interconnected by a connecting member 5*a* which is moved back and forth by means of a roller R1O carried by the lever H1. The inserting device 4 is moved back and forth between its solid line and phantom line positions by the lever H2 with the intermediary of a bar S1 articulated to the lever H2 at one end and to the inserting device 4 at the other end.

Each removal gripper 7 is formed as a two-armed lever swingable about a respective pivot 7*a*. The left removal gripper 7 has a groove N1, receiving a follower roller R11 carried at the end of the two-armed lever H4 which is swingably supported by pivot D7. The lever H4 is actuated by a bar S2 articulated to the two-armed lever H3 associated with the cam disc 49. A rod S3 couples the right removal gripper 7 with the left removal gripper 7 on opposite sides of their respective pivot so as to assure an opposite motion of the two removal grippers 7. The two-armed lever H5 associated with the cam track 49'' of the cam disc 49 moves the removing device 6 with the intermediary of a bar S4 in the direction of the arrow 6*a*.

The pivotal sled 8 is moved back and forth on a rail 51 by the lever H6 (associated with the cam track 50'') with the intermediary of a bar S5. The rail 51 is pivotal about an axis A. The pivotal motion of the guide rail 51 is controlled by the cam groove 50' of the cam disc 50, with the intermediary of the two-armed lever H7 and a connecting rod S6.

The transmission ratios are so selected in the drive that as the turntable 12 is rotated by one division of the vacuum hoods 1 (that is, about 25° according to the illustration in FIG. 1) in the direction of the arrow 28, the conveyor device 3 advances through a distance corresponding to two packages carried thereon in the direction of the arrow 30 and the cam discs 45, 46 and 47 each execute one revolution.

In the described embodiment, the rotary table 12 is moved continuously whereas the filling and conveying device 3 is moved intermittently and, in the tangential zone with the platform 12, it travels in a direction opposite to that of platform 12. It is to be understood that the type of motions and displacing devices may be varied without departing from the scope of the invention.

It will be understood that the above description of the present invention is susceptible to various modifications, changes and adaptations, and the same are intended to be comprehended within the meaning and range of equivalents of the appended claims.

What is claimed is:

1. In an apparatus for evacuating and sealing rectangular packages, including a turntable rotatable about a vertical axis thereof, a plurality of vacuum hoods, each defining a vacuum chamber, arranged circumferentially on said turntable and means for lifting each vacuum hood into an open position in which a package to be evacuated and sealed is received and for lowering each vacuum hood into a sealed, closed position, the improvement comprising (a) a first surface provided on each hood within the vacuum chamber;

(b) an abutment means arranged on said turntable below each said vacuum hood; each abutment means including a second surface; and (c) means for supporting the abutment means and for displacing the abutment means radially outwardly with respect to said vertical axis in the direction of said first surface for displacing a package towards said first surface by said second surface and engaging the package at opposite sides by said first and second surfaces in the closed position of the respective vacuum hood.

2. An apparatus as defined in claim 1, further comprising a pair of cooperating package grasping jaws arranged on said turntable below each said vacuum hood for engaging the package at opposite sides adjacent the sides to be engaged by said first and second surfaces.

3. An apparatus as defined in claim 2, wherein at least one of the jaws of each said pair is pivotally supported.

4. An apparatus as defined in claim 1, further comprising (d) a base plate arranged on said turntable below each said vacuum hood for engaging a bottom of the package received by the vacuum hood; and (e) means for supporting and vertically displacing said base plate.

5. An apparatus as defined in claim 1 further comprising (d) seal applying means supported by said turntable below each said vacuum hood for sealing a top of the package received by the vacuum hood; and (e) hold-down plates secured to said seal applying means; said hold-down plates being arranged to engage a top surface of said package during sealing of said top.

6. An apparatus as defined in claim 5, wherein said seal applying means comprises a pair of cooperating sealing jaws; one of said hold-down plates being secured to one of said sealing jaws.

7. An apparatus as defined in claim 1, wherein said abutment means and said means for supporting and displacing the abutment means are arranged for pushing the packages off said turntable in a radially outward direction from under the vacuum hood when said vacuum hood is in said open position.

8. An apparatus as defined in claim 7, further comprising a removal device situated radially externally of said turntable; said removal device including cooperating removal jaws for grasping packages pushed radially outwardly by said abutment means and a conveyor receiving articles from said removal jaws for transporting the packages away from said turntable.

9. An apparatus as defined in claim 1, further comprising (d) a linear conveyor means arranged generally tangentially to said turntable for transporting packages to and from said turntable;

(e) means for displacing packages to be evacuated and sealed from said linear conveyor means onto said turntable radially with respect to said vertical axis and perpendicularly to a direction of conveyance of said linear conveyor means; and (f) means for displacing evacuated and sealed packages from said turntable onto said linear conveyor means radially to said vertical axis and perpendicularly to said direction of conveyance.

10. In an apparatus for evacuating and sealing rectangular packages having a top face, a bottom face and four side faces, including a turntable rotatable about a vertical axis thereof, a plurality of vacuum hoods, each defining a vacuum chamber, arranged circumferentially on said turntable and means for lifting each vacuum hood into an open position in which a package to be evacuated and sealed is received and for lowering each vacuum hood into a sealed, closed position, the improvement comprising (a) a first surface provided on each hood within the vacuum chamber;

(b) an abutment means arranged on said turntable below each said vacuum hood; each abutment means including a second surface;

(c) means for supporting the abutment means and for displacing the abutment means radially outwardly with respect to said vertical axis in the direction of said first surface for displacing a package towards said first surface by said second surface and engaging the package at opposite sides by said first and second surfaces in the closed position of the respective vacuum hood;

(d) a pair of cooperating package grasping jaws arranged on said turntable below each said vacuum hood for engaging the package at opposite sides adjacent the sides to be engaged by said first and second surfaces;

(e) a base plate arranged on said turntable below each said vacuum hood for engaging a bottom of the package received by the vacuum hood;

(f) means for supporting and vertically displacing said base plate;

(g) sealing means supported by said turntable below each said vacuum hood for sealing a top of the package received by the vacuum hood;

(h) hold-down plates secured to said sealing means; said hold-down plates being arranged to engage a top surface of said package during sealing of said top; and (i) said first and second surfaces, said package grasping jaws, said base plate and said hold-down plates simultaneously engaging the four sides, the bottom and the top of the package during an operational phase in the course of evacuating and sealing.

* * * * *